US006816054B2

(12) United States Patent
Lin

(10) Patent No.: US 6,816,054 B2
(45) Date of Patent: Nov. 9, 2004

(54) SILICON STEEL CORE FOR TRANSFORMERS OR CHOKE COILS

(76) Inventor: Kuo-Liang Lin, No. 1-3, Da-Chueh-Wei, Da-Chueh Tsun, Shui-Shang Hsiang, Chia-Yi Hsien (TW)

( * ) Notice: Subject to any disclaimer, the term of this patent is extended or adjusted under 35 U.S.C. 154(b) by 0 days.

(21) Appl. No.: 10/383,644

(22) Filed: Mar. 10, 2003

(65) Prior Publication Data

US 2004/0178877 A1 Sep. 16, 2004

(51) Int. Cl.[7] ..... H01F 27/24

(52) U.S. Cl. ..... 336/234; 336/212; 336/213; 336/233

(58) Field of Search ..... 336/234, 233, 336/212, 213, 216, 217, 133

(56) References Cited

FOREIGN PATENT DOCUMENTS

EP 556939 A1 * 8/1993

* cited by examiner

*Primary Examiner*—Lincoln Donovan
*Assistant Examiner*—Jennifer A. Poker
(74) *Attorney, Agent, or Firm*—Birch, Stewart, Kolasch & Birch, LLP

(57) ABSTRACT

A silicon steel core for transformers or choke coils includes at least one silicon steel sheet core which has at least two sets of silicon steel sheets that have respectively a magnetic flux section of a different length such that when two sets of the silicon steel sheet cores are coupled, the magnetic flux sections form at least two gaps of different intervals. Thereby the silicone steel sheet sets of a smaller gap can provide adequate electric induction for the transformers or choke coils while the silicone steel sheet sets of a greater gap can reduce the saturated condition when the transformers or choke coils are in the high load condition.

8 Claims, 6 Drawing Sheets

SILICON STEEL CORE FOR TRANSFORMERS OR CHOKE COILS

FIELD OF THE INVENTION

The present invention relates to an improved silicon steel core for transformers or choke coils and particularly to a silicon steel core that provides a desired induction for transformers or choke coils and improves magnetic saturated functions.

BACKGROUND OF THE INVENTION

Various types of choke coils are widely used in electric products of different functions. They also play a very important role in the power supply of the electric products. The choke coils can increase energy utilization efficiency and reduce power supply interference in the electric systems. In addition to improving service life of the electric devices, they also can protect environments. Thus they are simple and indispensable elements in many electric products.

The general transformers or choke coils have silicon steel sheet cores made of a first silicon steel sheet core 3 and a second silicon steel sheet core 4 formed in E and I shapes (as shown in FIGS. 1 and 2). When the first and the second silicon steel sheet cores 3 and 4 are coupled, their magnetic flux sections correspond to each other. Moreover, there is an insulated spacer 5 located between the central magnetic flux sections 31 and 41 of the first and the second silicon steel sheet cores 3 and 4. The thickness of the spacer 5 may adjust the gap of the magnetic flux sections 32, 32', 42 and 42' on two flanks of the first and the second silicon steel sheet cores 3 and 4. As the size of the gap determines the inductance output by the transformers or choke coils, when the gap is small, the magnetic resistance of the line of magnetic force running on the magnetic path decreases, the electric induction being formed is greater, thus the choke coil has sufficient electric induction even in a small load condition. However, when the load is high, the magnetic core is easy to become saturated. When the gap is larger, the magnetic resistance of the line of magnetic force running on the magnetic path increases, the electric induction being formed is smaller. While it is not easily saturated in the high load condition, it also cannot achieve the required electric induction in the small load condition unless the number of copper coils or silicon steel sheets increases.

The gaps on the two flanks of the first and the second silicon steel sheet cores 3 and 4 are equal. As the gap determines the saturated current and induction, in the event that the number of copper coils and silicon steel sheets cannot be increased due to space constraint or cost reason, to raise the induction to a desired level and to increase the saturated current of the transformers or choke coils at the same time become very difficult.

In addition, the harmonic test (European regulations) usually has an upper limit value (depending on the required power set by electric devices) and a lower limit value (minimum 75W according to the present requirement, and must reach 50W in 2004). For the transformer or choke coil made of the silicon steel sheet sets of an equal gap discussed above to achieve the minimum limit value, the electric induction must increase. Then the gap of the silicon steel sheets must be reduced. As a result, the magnetic core of the transformer or choke coil is easy to become saturated when the electric device is in the high load condition. And the device cannot pass the harmonic test in the heavy load condition. To pass the harmonic test, the number of copper coils or silicon steel sheets has to be increased to boost the induction. This causes fabrication difficulty and rising cost.

SUMMARY OF THE INVENTION

Therefore the primary object of the invention is to resolve the aforesaid disadvantages. The invention provides a gap design for the first and the second silicon steel sheets that has gaps of different intervals so that they can supply induction required in the low load condition and also has a larger gap to meet the requirements in the high load condition.

Another object of the invention is to reduce fabrication cost.

Yet another object of the invention is to conform to the harmonic test requirements.

In order to achieve the foregoing objects, the improved silicon steel core of the invention includes at least one silicon steel sheet core which has at least two sets of silicon steel sheets. Each set of silicon steel sheets has a magnetic flux section of a different length. When the two sets of corresponding silicon steel sheets are coupled, every magnetic flux section forms at least two gaps of different intervals to provide outputs of different power supply (watts).

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
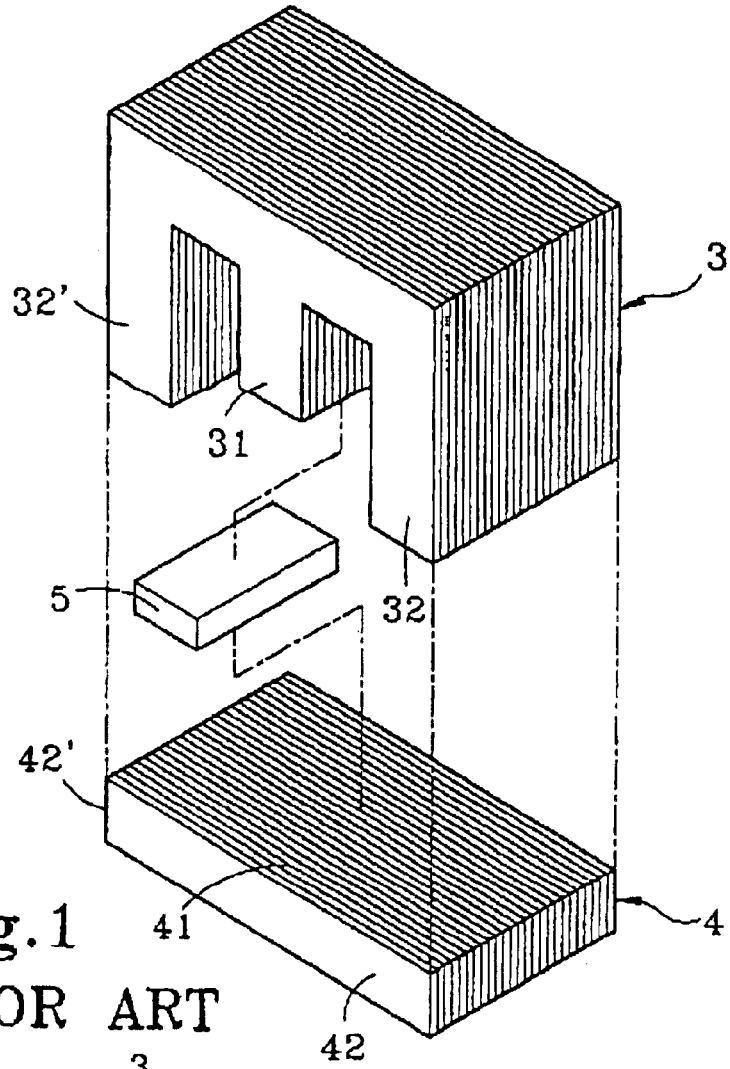
Fig.1 PRIOR ART
FIG. 1 is a perspective view of a silicon steel core of a conventional transformer or choke coil.
Figure 2:
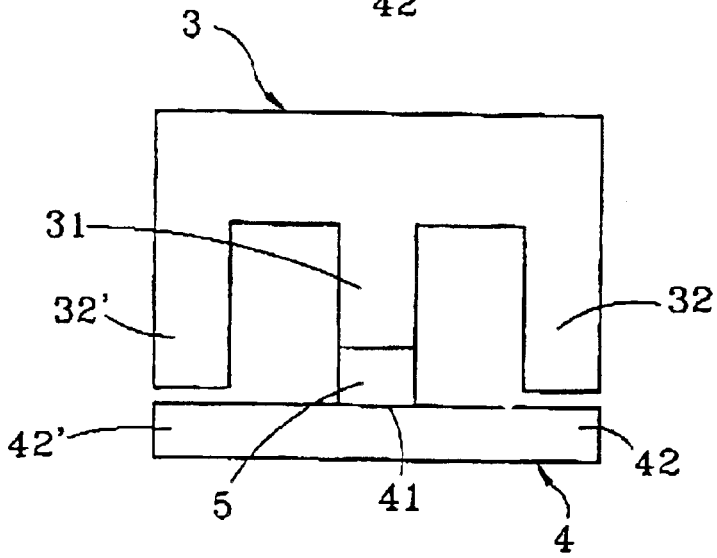
Fig.2 PRIOR ART
FIG. 2 is a front view according to FIG. 1.
Figure 3:
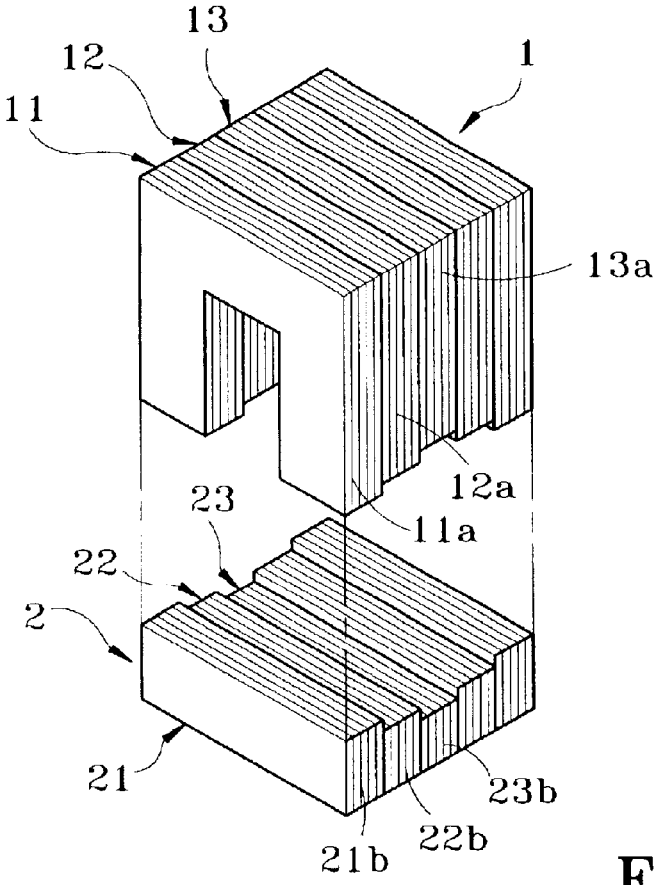
FIG. 3 is a perspective view of a silicon steel core of a transformer or choke coil of the invention.
Figure 4:
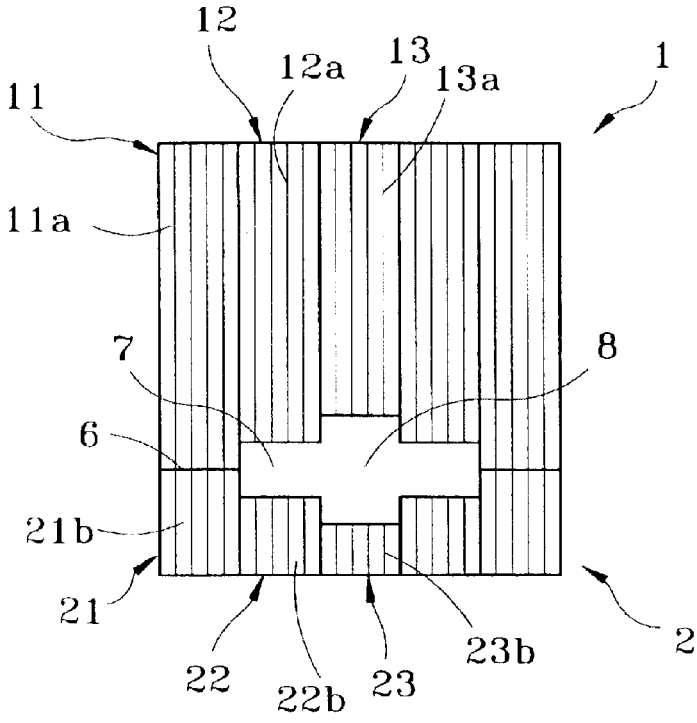
FIG. 4 is a side view according to FIG. 3.

Referring to FIGS. 3 and 4, the silicon steel core for transformers or choke coils of the invention includes a first silicon steel sheet core 1 and a second silicon steel sheet core 2. Each silicon steel sheet core consists of a plurality of sets made of silicon steel sheets of different lengths to form gaps of multiple stages or parabolas or arched shapes. The different gaps formed in the shapes of multiple stages or parabolas or arches enable the transformer or choke coil to have magnetic loops of different magnetic resistance to be adopted on electric products that require a greater power supply and also conform to the lower limit of harmonic test.

Conventional transformers or choke coils use a silicon steel core consisting of two sets of silicon steel sheets with a gap between them. The gap may also be formed by an insulation material. The size of the gap determines the induction output by the transformer or choke coil. A small gap results in a small magnetic resistance of the line of magnetic force running on the magnetic path. Thus a greater electric induction may be achieved, and the choke coil may still have adequate electric induction in the low load condition. But the magnetic core tends to become saturated in the high load condition. On the other hand, a large gap will result in a greater magnetic resistance of the line of magnetic force running on the magnetic path. Thus a smaller electric induction is formed. While the magnetic core is less likely to become saturated in the high load condition, the choke coil cannot achieve the required electric induction during the low load condition.

According to the invention, the first silicon steel sheet core 1 has at least a first set 11, a second set 12 and a third set 13 of silicon steel sheets (for instance, each set has five sheets or more to form a unit). Each set of silicon steel sheets 11, 12, and 13 has a plurality or at least one silicon steel sheet. And each set of silicon steel sheets 11, 12, and 13 has two flanks to form respectively a magnetic flux section 11*a*, 12*a* and 13*a* that have different lengths. The first silicon steel sheet core 1 is composed of two sets of the first and the second silicon steel sheets 11 and 12 and one set of the third silicon steel sheets 13.

The second steel sheet core 2 consists of at least a first set 21, a second set 22 and a third set 23 of silicon steel sheets. Each set of silicon steel sheets 21, 22, and 23 has a plurality or at least one silicon steel sheet. Each set of silicon steel sheets 21, 22, and 23 has a different width and two flanks to form respectively a magnetic flux section 21*b*, 22*b* and 23*b*. The second silicon steel sheet core 2 is composed of two sets of the first and the second silicon steel sheets 21 and 22 and one set of the third silicon steel sheets 23.

When the first silicon steel sheet core 1 and the second silicon steel sheet core 2 are coupled, the magnetic flux section 11*a* and 21*b* of the two flanks of the first sets of the silicon steel sheets 11 and 21 are in contact with each other to form a smallest gap 6; two sets of the second sets of the silicon steel sheets 12 and 22 and one set of the third set of the silicon steel sheets 13 and 23 form respectively a gap 7 and 8 of different intervals. The gaps 6, 7 and 8 determine the electric induction output by the transformer or choke coil, and the electric induction is used to determine suitable power output.

Example 1: when a transformer or choke coil is used in a low power condition (such as 50W), the main path of the magnetic flux routes from the magnetic flux section 11*a* located on the left side of the two first sets 11 of the silicon steel sheets of the first silicon steel sheet core 1 to the magnetic flux section 21*b* located on the left side of the two first sets 21 of the silicon steel sheets of the second silicon steel sheet core 2, then from the magnetic flux section 21*b* located on the left side of the two first sets 21 of the silicon steel sheets of the second silicon steel sheet core 2 to the magnetic flux section 11*a* located on the right side of the two first sets 11 of the silicon steel sheets of the first silicon steel sheet core 1. Meanwhile, other sets of silicon steel sheets (12, 13 and 22, 23) also have magnetic flux. But because of the gaps 7 and 8, the resulting electric induction is lower. The main electric induction is generated by magnetic fields of the first sets 11 and 21 of silicon steel sheets.

Example 2: when a transformer or choke coil is used in a higher power condition (such as 300W), every set 11, 12, 13, 21, 22, and 23 of silicon steel sheets has magnetic flux. The strong magnetic field will cause the silicon steel sheets (11, 21, 12 and 22) of the gaps 6 and 7 to become saturated, while the silicon steel sheets (13 and 23) of the larger gaps 7 and 8 are not saturated, thus can provide a portion of induction to the transformer or choke coil. Therefore the transformer or choke coil may still function even if the entire magnetic core reaches a saturated condition.

Figure 5:
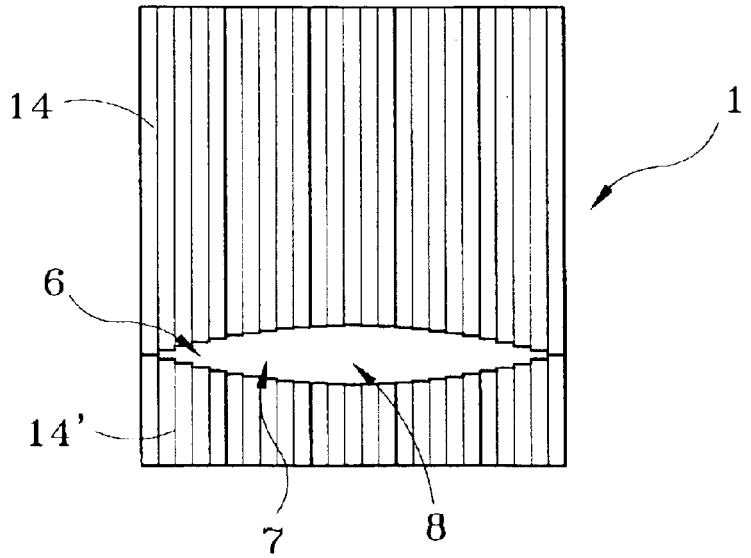
FIG. 5 is a schematic view of the second embodiment of the invention.

Refer to FIG. 5 for another embodiment of the invention. It is substantially same as the one shown in FIG. 3. The difference is that at least one half of the two flanks 14 and 14' of the silicon steel sheets used in the first and the second silicon steel sheet cores 1 and 2 have different lengths. When the first and the second silicon steel sheet cores 1 and 2 are coupled, the gaps 6, 7 and 8 are formed in a parabolic or arched shape to provide different outputs of electric induction and may be adopted for products of different output powers.

Figure 6:
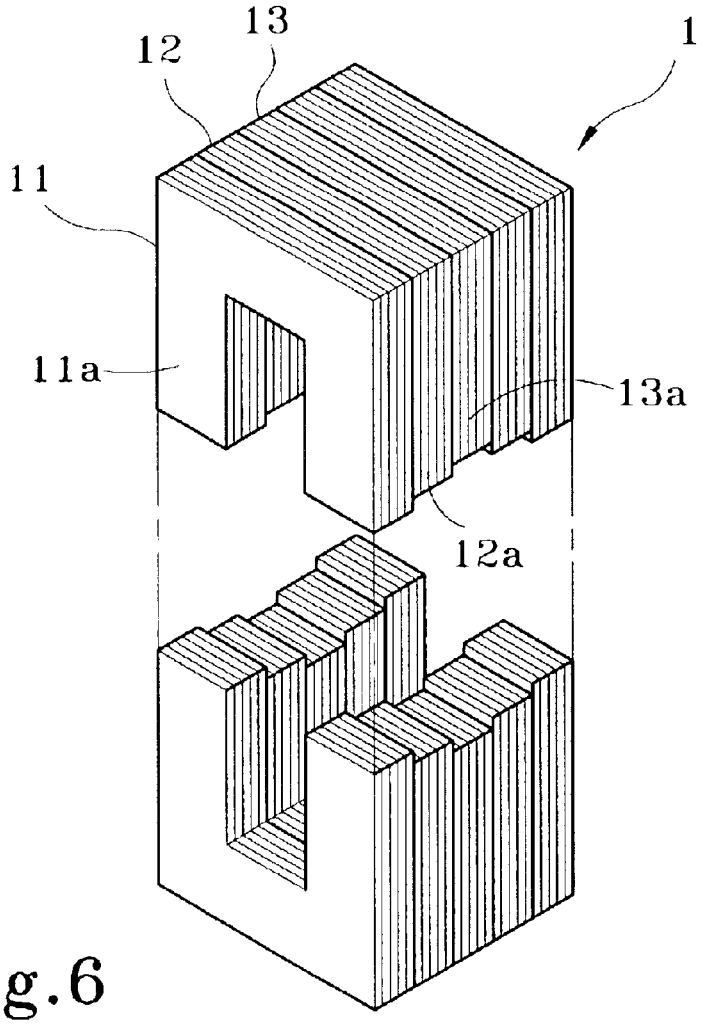
FIG. 6 is a schematic view of the third embodiment of the invention.
Figure 7:
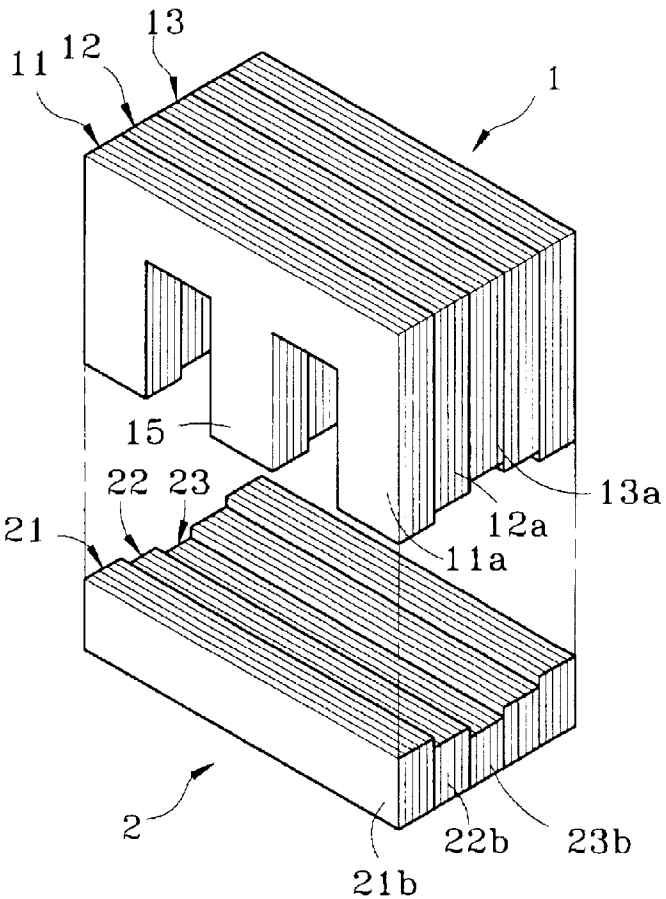
FIG. 7 is a schematic view of the forth embodiment of the invention.

Refer to FIGS. 6 and 7 for other embodiments of the invention. The first and the second silicon steel sheet cores 1 and 2 are formed in the same U-shape or E-shape. Thus only one set of the first or second silicon steel sheet core 1 or 2 needs to be fabricated. It can simplify production and reduce costs. Moreover, the central magnetic flux section 15 and the magnetic flux sections 11*a* on two flanks of the first and second silicon steel sheet core 1 and 2 have the same length.

Figure 8:
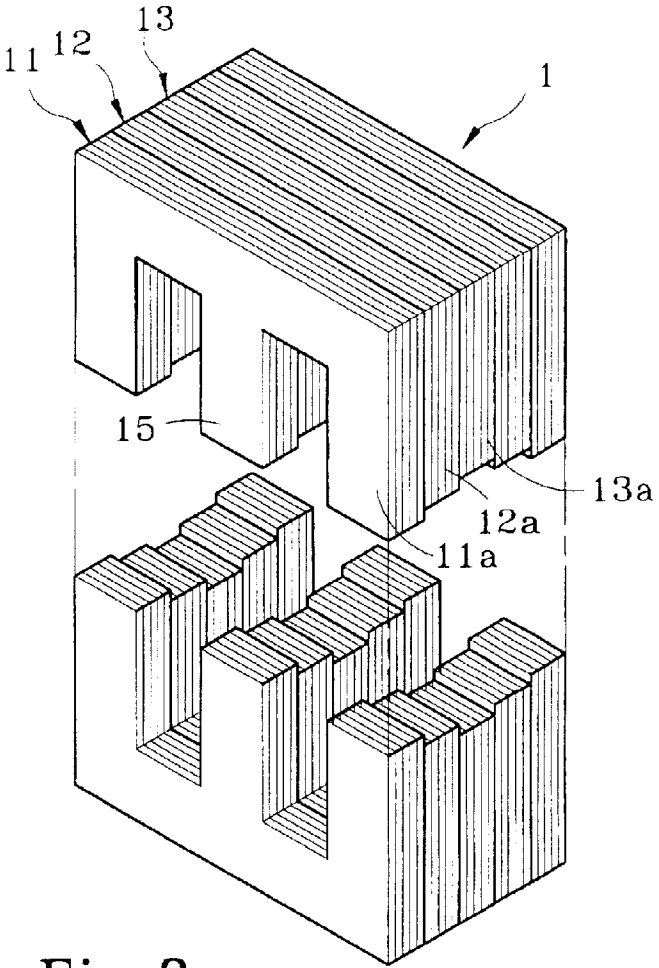
FIG. 8 is a schematic view of the fifth embodiment of the invention.

Refer to FIG. 8 for a further embodiment of the invention. In this embodiment, the first silicon steel sheet core 1, in addition to the U-shape discussed before, may also be made in E-shape to couple with an I-shaped second silicon steel sheet core 2.

Figure 9:
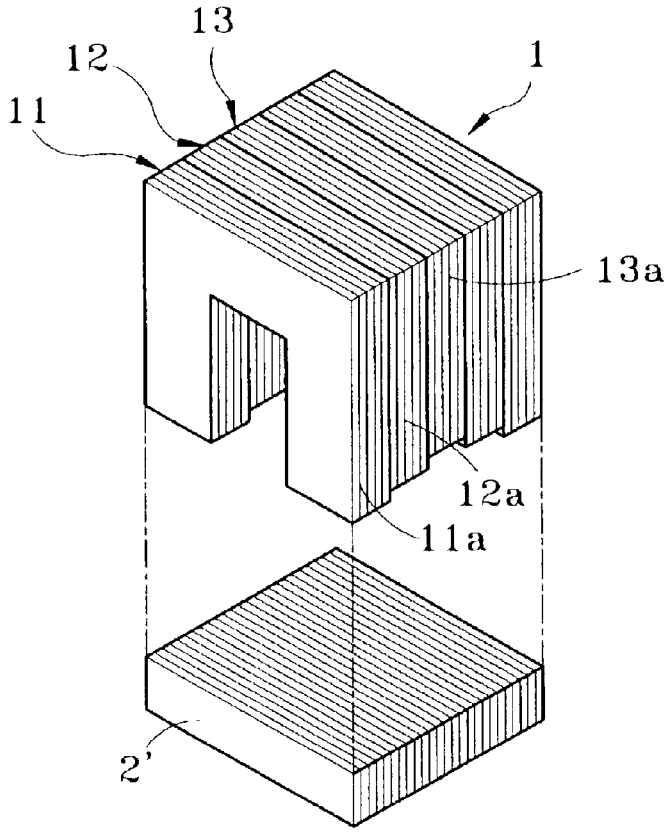
FIG. 9 is a schematic view of the sixth embodiment of the invention.
Figure 10:
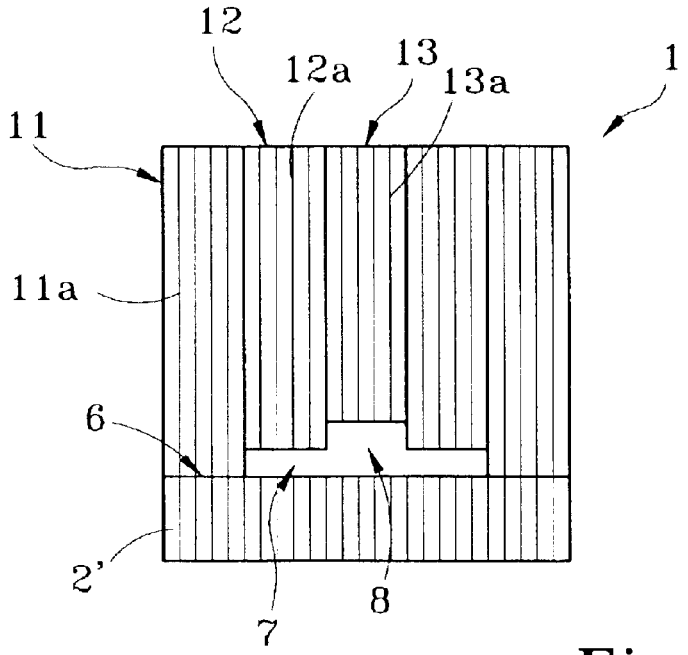
FIG. 10 is a front view according to FIG. 9.

Refer to FIGS. 9 and 10 for yet another embodiment of the invention. In this embodiment, the first silicon steel sheet core 1 is same as the one shown in FIG. 3. However, every silicon steel sheet of the second silicon steel sheet core 2' has the same width. Thus when the first and second silicon steel sheet cores 1 and $_2$' are coupled, the gaps 6, 7 and 8 being formed still have different intervals to output different electric induction and may be adopted for products of different output powers.

Figure 11:
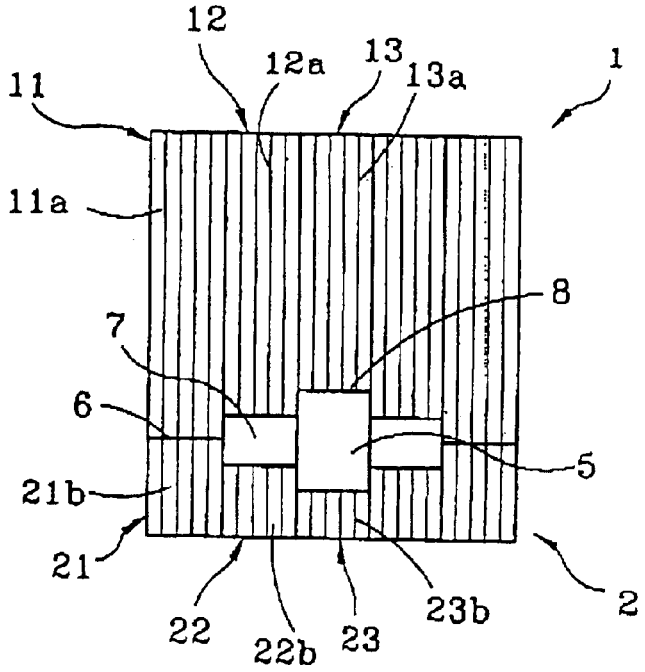
FIG. 11 is a schematic view of the seventh embodiment of the invention.

Furthermore, the gaps of different intervals in the transformers or choke coils of the invention, besides being adjusted by the length of the magnetic flux section of the silicon steel sheets, may also be used to bridge a spacer 5 (as shown in FIG. 11) between the first and the second silicon steel sheet cores 1 and 2. The thickness of the spacer 5 may be used to adjust the size of the gaps.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A silicon steel core for transformers or choke coils comprising:

two silicon steel sheet cores with at least one of said silicon steel sheet cores having at least two sets of silicon steel sheets that have respectively magnetic flux sections of different lengths, a gap being formed between a magnetic flux section of each set and the other silicon steel sheet core, the gaps of adjacent sets having a different length, so as to provide outputs of different powers.

2. The silicon steel core of claim 1, wherein each set of the silicon steel sheets has a plurality of silicon steel sheets.

3. The silicon steel core of claim 2, wherein the length of the magnetic flux sections is unequal to selectively form a stepwise, a parabolic or an arched shape.

4. The silicon steel core of claim 1, wherein the gap formed between two magnetic flux sections of the two sets of the silicon steel sheet core has a spacer located therein, the spacer having a thickness for adjusting the gaps.

5. The silicon steel core of claim 4, wherein the space is selectively formed in a stepwise shape.

6. The silicon steel core of claim 1, wherein the silicon steel sheet core is selectively formed in U-shape, E-shape or I-shape.

7. The silicon steel core of claim 1, wherein the at least two sets of the silicon steel sheet core are formed in a same shape or different shapes.

8. The silicon steel core of claim 1, wherein both of said silicon steel sheet cores have sets of silicon steel sheets with magnetic flux sections of different lengths.

* * * * *